US005940996A

United States Patent [19]

Cummings

[11] Patent Number: 5,940,996

[45] Date of Patent: Aug. 24, 1999

[54] MATERIAL EJECTING LOADER BUCKET

[76] Inventor: William D. Cummings, P.O. Box 1635, Garden City, Kans. 67846-1635

[21] Appl. No.: 09/013,297

[22] Filed: Jan. 26, 1998

[51] Int. Cl.[6] ..... E02F 3/76

[52] U.S. Cl. ..... 37/409; 37/444; 37/901

[58] Field of Search ..... 37/444, 409, 410, 37/411, 403, 901, 903, 904, 416

[56] References Cited

U.S. PATENT DOCUMENTS

| | | | |
|---|---|---|---|
| 2,828,038 | 3/1958 | Dorkins . | |
| 3,341,041 | 9/1967 | Salna | 37/901 X |
| 3,397,345 | 8/1968 | Dunlavey . | |
| 4,051,614 | 10/1977 | Diggs . | |
| 4,144,980 | 3/1979 | Meyer . | |
| 4,566,844 | 1/1986 | Campin | 37/409 X |
| 4,974,350 | 12/1990 | Puckett | 37/409 |
| 5,348,361 | 9/1994 | Ilchuk | 37/901 X |

*Primary Examiner*—Christopher J. Novosad
*Attorney, Agent, or Firm*—Edward L. Brown, Jr.

[57] ABSTRACT

The present invention is directed toward a loader bucket which has a back bucket assembly, a front bucket assembly that pivotably mounts to the back bucket assembly forming an extension thereof in the closed position and an actuator for pivoting the front bucket assembly relative to the back bucket assembly. The front bucket assembly includes an ejector panel that is adapted to swing behind the front bucket assembly and through the back bucket assembly as the front bucket assembly is pivoted by the actuator relative to the back bucket assembly. As the ejector panel sweeps through the back bucket assembly it sweeps out of the back bucket assembly without dumping the back bucket assembly. The lower wall of the back bucket assembly is cylindrically contoured to closely clear the ejector panel as it sweeps through the back bucket assembly.

10 Claims, 3 Drawing Sheets

MATERIAL EJECTING LOADER BUCKET

FIELD OF THE INVENTION

The present invention relates to loader buckets of the type that are used with tractor loader vehicles. Generally, tractor loader vehicles in combination with loader buckets are used to scoop up materials from a first location, carry the materials and then dump the materials at a second location. The present invention features an extension of the loader bucket having an apparatus for ejecting materials.

PRIOR ART

An example of a clam-shell bucket having a material ejecting means can be found in U.S. Pat. No. 2,828,038 issued to Dorkins. Dorkins describes a clam-shell excavator having a pair of opposite clam-shell buckets pivotably mounted to a structure which has a fixed pair of ejector plates. The clam shell buckets in Dorkins are adapted so that when they are opened, the stationary ejector plates sweep material from the clam-shell buckets.

Another clam-shell bucket arrangement is described in U.S. Pat. No. 3,341,041 issued to Salna. Salna discloses a clam-shell loader bucket that is mounted on a loader vehicle boom arm. Salna's clam-shell loader bucket has a front bucket that can swing relative to a back bucket so that materials can be dumped from the loader bucket from an elevated position.

U.S. Pat. No. 3,397,345 issued to Countryman describes a loader bucket having a sliding push plate. In Countryman, the sliding push plate is reciprocated in the loader bucket by a telescopic cylinder.

U.S. Pat. No. 4,051,614 issued to Diggs teaches a plate which is rotated by a separate power means to sweep out dirt within a loader bucket.

U.S. Pat. No. 4,144,980 issued to Meyer describes a one-piece loader bucket having an internal ejector plate that is articulated to fold back into the rear of the bucket and which is straitened and pushed forward by an hydraulic cylinder mounted to the bucket and the ejector plate.

U.S. Pat. No. 5,348,361 issued to llchuk discloses a clam-shell tree excavator having opposite clam-shell buckets with hydraulically actuated pusher blades that are pivotably mounted to the upper inside margins of each of the clam-shell buckets.

BRIEF DESCRIPTION OF THE INVENTION

The present invention is directed toward a loader bucket which has a back bucket assembly, a front bucket assembly that pivotably mounts to the back bucket assembly and an actuator means for pivoting the front bucket assembly relative to the back bucket assembly. The front bucket assembly includes an ejector panel that is adapted to swing behind the front bucket assembly and through the back bucket assembly as the front bucket assembly is pivoted by the actuator. As the ejector panel moves through the back bucket assembly, it sweeps out of the back bucket assembly of any material in the back bucket. The lower wall of the back bucket assembly is cylindrically contoured to closely clear the ejector panel as it sweeps through.

Because the loader bucket of the present invention can be emptied without having to tilt the entire bucket to a lower dump position, it can be used to transfer materials to an elevated location such as an high walled bin for holding materials. This feature allows an operator to transfer materials over relatively high obstacles without first obtaining a larger loader vehicle. Consequently, in many applications, the loader bucket of the present invention allows the transfer of materials to elevated dumping locations with a small loader vehicle which previously could only have been done with a large loader vehicle.

Therefore, the principal object of the present invention is to provide a loader bucket that can be maneuvered into a high position and discharged without having to tilt the loader bucket into a dump position.

A further object of the present invention is to provide a loader bucket having an ejector panel that sweeps and clears a substantial portion of the loader bucket.

A still further object of the present invention is to provide a clam-shell type loader bucket capable of performing typical functions of a clam-shell type loader bucket such as clamping and lifting objects.

BRIEF DESCRIPTION OF THE DRAWINGS

The following detailed description refers to the attached drawings in which.

DETAILED DESCRIPTION OF THE PREFERRED EMBODIMENT

Figure 1:
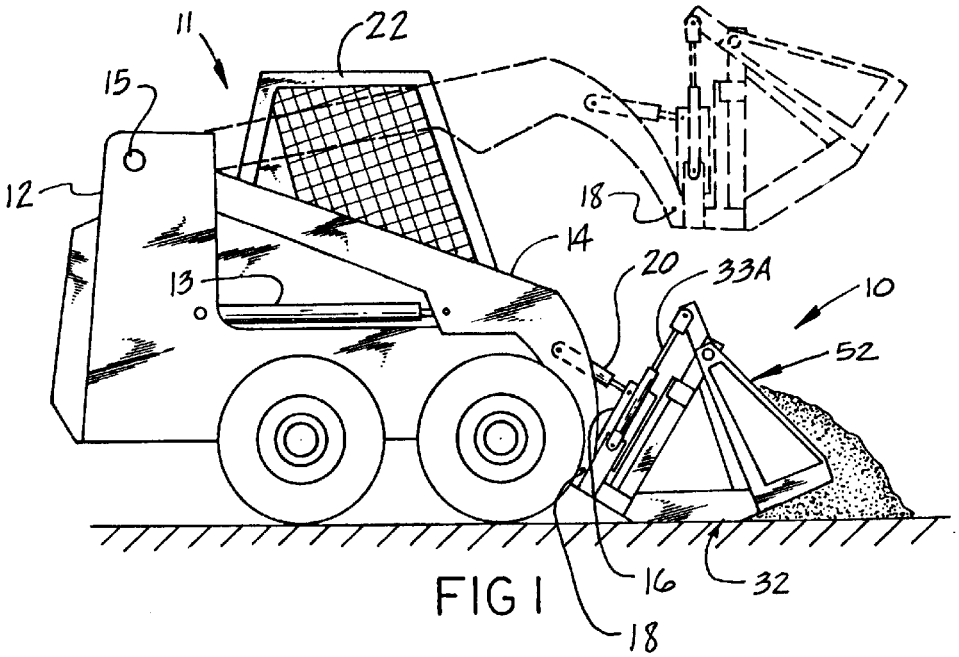
FIG. 1 is a side view of the loader bucket of the present invention mounted to a loader vehicle.
Figure 5:
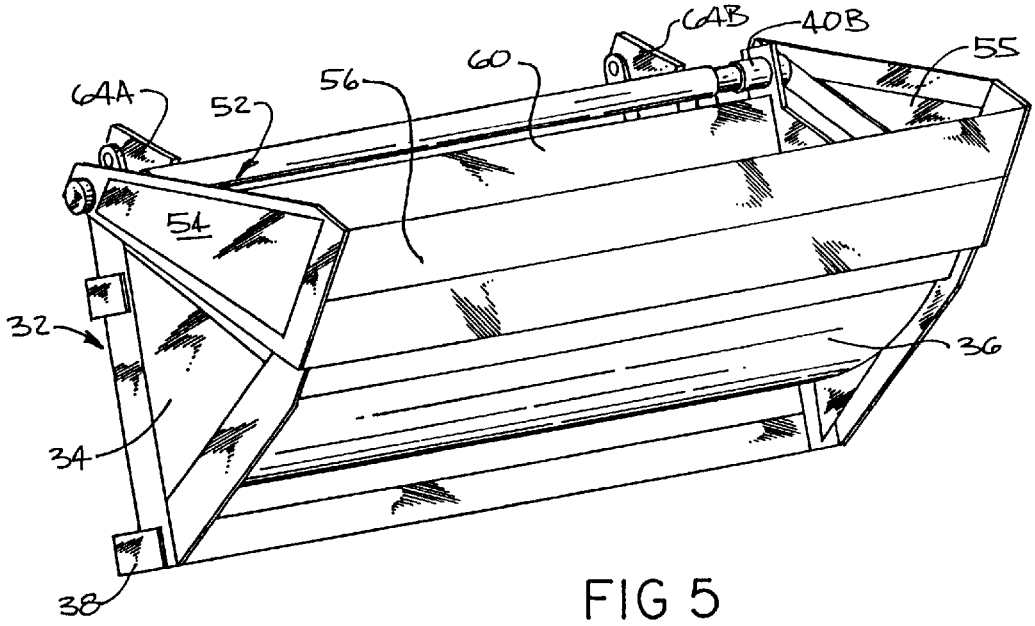
FIG. 5 is a right side perspective view of the loader bucket in its FIG. 3 position.
Figure 6:
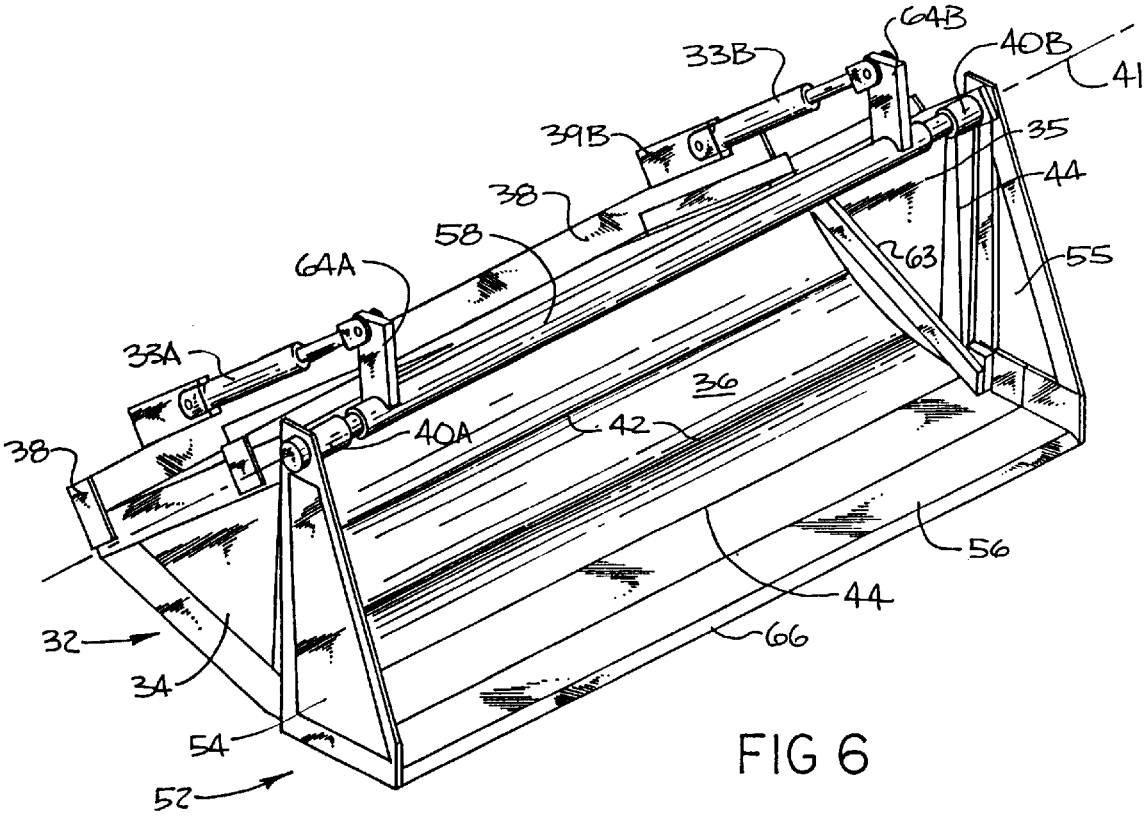
FIG. 6 is a right side perspective view of the loader bucket in its FIG. 2 position; and, FIG. 7 is a right side perspective view of the loader bucket in its FIG. 4 position.
Figure 7:
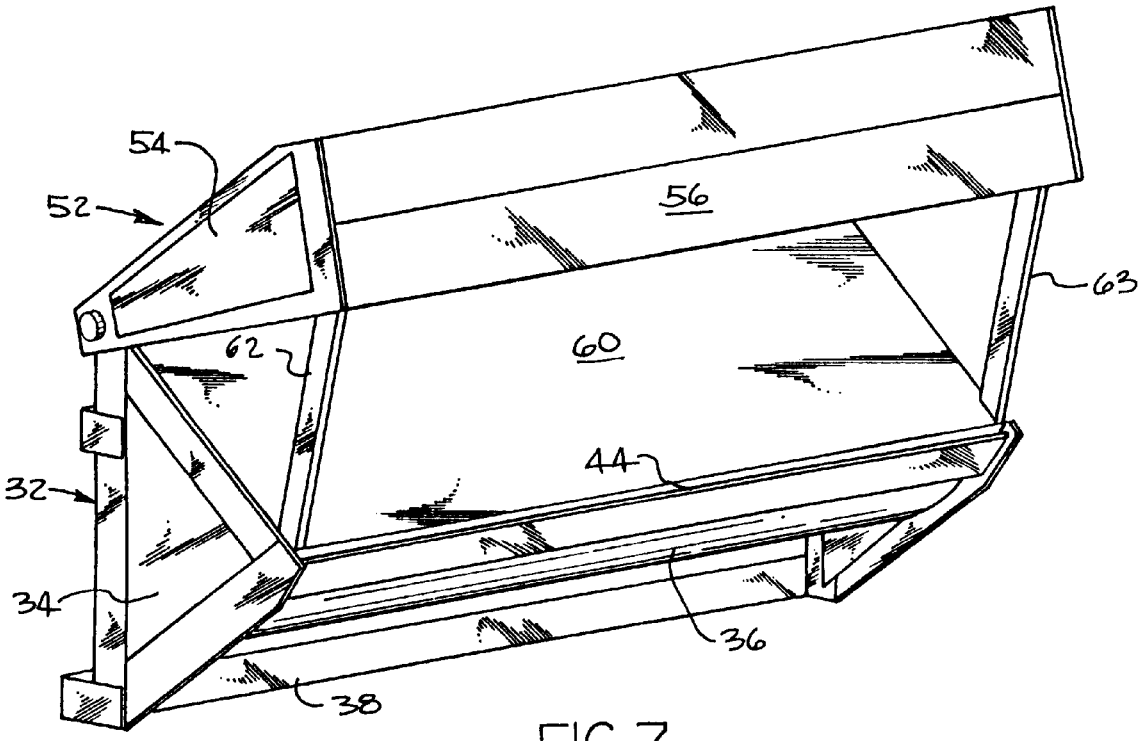

The loader bucket of the present invention is shown in FIG. 1 and is generally described by reference numeral 10. In FIG. 1, loader bucket 10 is shown mounted on a skid loader vehicle 11 which includes a vehicle 12, a control station 22, a boom 14 and a bucket attachment fitting 16. Boom 14 is pivotably mounted to the vehicle 12 at boom pivot 15 and can be raised and lowered by a boom actuator cylinder 13 that is attached to boom 14, all of which is conventional structure. Bucket attachment fitting 16 mounts to the boom 14 at an attachment pivot 18 and is fastened to loader bucket 10. A bucket actuator cylinder 20 attaches to boom 14 and bucket attachment fitting 16 and is used to tilt loader bucket 10 relative to boom 14. An operator (not shown) can control the boom 14 and loader bucket 10 from operator cab 22 by operating boom actuator cylinder 13 and bucket actuator cylinder 20. FIGS. 5, 6 and 7 illustrate the loader bucket in different positions. In FIG. 5, the loader bucket is shown in a tilted back loaded position with the front bucket assembly providing an extension to the back bucket assembly by providing increased capacity of the overall bucket. FIG. 6 illustrates the loader bucket with the loader bucket tilted forward in its pickup position. FIG. 7 illustrates the loader bucket 10 with its front assembly fully extended with the ejector panel 60 fully sweeping the back bucket assembly 32.

Loader bucket 10 generally includes two separate assemblies that pivot relative to one another, a back bucket assembly 32 and a front bucket assembly 52 which acts as an extension of bucket 10. Hydraulic cylinders 33A and 33B are also controlled from operator cab 22 and are used to pivot front bucket assembly 52 relative to back bucket assembly 32. As seen in FIG. 6, back bucket assembly 32 is a welded construction including the components of a lower wall 36, a rear support structure 38, a right side panel 34 and a left side panel 35. Right side panel 34 and left side panel 35 are positioned at opposite ends of back bucket assembly 32 and are identical opposites. Each of side panels 34 and 35 can be constructed from a single panel or plate or could be a built up structure comprising a web and edge stiffening members. The upper margins of side panels 34 and 35 include normally mounted cylindrical bearings 40A and 40B. Lower wall 36 is arcuate in shape and includes several transverse bends 42 which define a polygonal contour that is broken about every ten degrees. Cylindrical bearings 40A and 40B in each of right side panel 34 and left side panel 35 are centered on a transverse axis 41 and lower wall 36 is positioned at a substantially constant radius from transverse axis 41. The front edges of panel 34, panel 35, and lower wall 36 define a front edge 44 for back bucket assembly 32. Rear support structure 38, which is common to interchangeable buckets in the prior art, is adapted for latching on to loader bucket attachment fitting 16 shown in FIG. 1 and a pair of support fittings 39A and 39B for supporting hydraulic cylinders 33A and 33B.

Although a continuous cylindrical contour could be selected for lower wall 36, the broken polygonal contour of the preferred embodiment gives lower wall 36 a greater rigidity capability to resist bending. This allows loader bucket 10 to carry heavier loads while having less weight in the structure of the loader bucket. While rear support structure 38 is a rigid framework of vertical and horizontal members, any plate or panel or generally planar structure could be used to provide support. Each of side panels 34 and 35 could consist of any solid plate or any built-up panel like structure. Further, cylindrical bearings 40A and 40B fixed to side panels 34 could be replaced by any means for providing pivotable actuation for front bucket assembly 52. Cylinders 33A and 33B are hydraulically connected in series with matching volumes or some other well known hydraulic or mechanical means to maintain the pair of cylinders in phase with each other, which is not shown in the drawings. Cylinders 33A and 33B could be replaced by a single cylinder.

Figure 2:
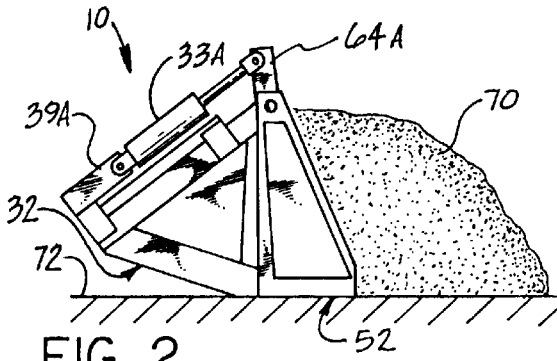
FIG. 2 is a side view of the loader bucket in its pickup position.
Figure 3:
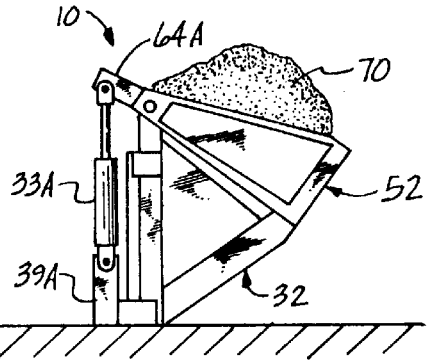
FIG. 3 is a side view of the loader bucket in its loaded and lifting position.
Figure 4:
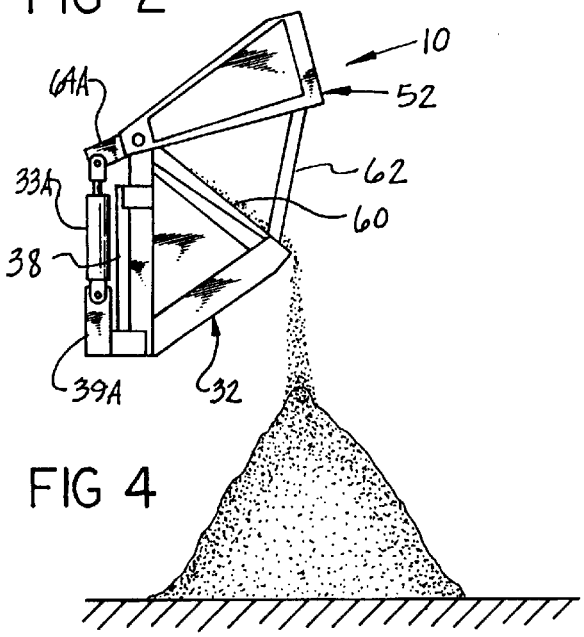
FIG. 4 is a side view of the loader bucket in its raised dumping position.

As is also shown in FIG. 6, front bucket assembly 52 is mounted to the back bucket assembly 32 so that it can pivot about transverse axis 41 in relation to back bucket assembly 32 through the action of cylinders 33A and 33B. Front bucket assembly 52 comprises a welded integral structure including a right side wall 54, a left side wall 55, a bottom plate 56, a transverse shaft 58, an ejector panel 60, as seen in FIGS. 7, 4 and 5, and a pair of support legs 62 and 63 connecting ejector panel 60 to each of the side walls 54 and 55 respectively. A pair of lugs 64A and 64B project radially from transverse shaft 58 and provide actuating torque to assembly 52. When loader bucket 10 is assembled, transverse shaft 58 is rotatably mounted in cylindrical bearings 40A and 40B in each panel 34 and 35. Hydraulic cylinders 33A and 33B are connected to support fittings 39A and 39B of rear support structure 38 and lugs 64A and 64B of transverse shaft 58 respectively as seen in FIGS. 2 and 6.

Bottom plate 56 has a beveled forward edge 66 adapted for scooping lose material from a flat surface. In its FIG. 6 position, front bucket assembly 52 slightly overlaps the edge 44 of rear bucket assembly 32, which overlapping relationship provides increased strength as to lateral loads on front bucket assembly 52. Ejector panel 60 is connected to side walls 54 and 55 by support arms 62 and 63, as seen in FIGS. 4 and 7. Ejector panel 60 is also secured to transverse shaft 58 thereby completing a rigid assembly that can pivot as transverse shaft 58 is pivoted about axis 41. As can be seen in FIGS. 5, 6 and 7, front bucket assembly 52 is pivotally mounted to back bucket assembly 32 with transverse shaft 58 carried concentrically in bearings 40A and 40B.

As can be seen in FIG. 6, the front bucket assembly 52 is closed in overlapping relation against back bucket assembly 32, each of side walls 54 and 55 fit up against and act as extensions of the corresponding side panels 34 and 35 of back bucket assembly 32. Similarly, bottom plate 56 acts in a like manner with lower wall 36 of back bucket assembly 32. In this position, ejector panel 60 and support legs 62 and 63 fit inside back bucket assembly 32 and ejector panel 60 is generally parallel to and adjacent to rear support structure 38 of back bucket assembly 32. Ejector panel 60 is sized so that its edges closely clear side panels 34 and 35 and lower curved wall 36. Because lower curved wall 36 is disposed at a generally constant radius from transverse axis 41, the edge of ejector panel 60 clears lower wall 36 by 0.012 inches as front bucket assembly 52 is rotated about transverse axis 41.

OPERATION

FIGS. 2, 3, 4 and 7 show how loader bucket 10 operates. In FIG. 2, loader bucket 10 is closed and sits on a working surface behind a pile of loose material 70. In this position, bottom plate 56 of front bucket assembly 52 is flat against working surface 72. As loader bucket 10 slides forward on working surface 72, it fills with loose material 70. Once filled with loose material 70, loader bucket 10 is tilted upward into a carrying position, as shown in FIG. 3B, by retraction of cylinder 20. Bucket 10 is then lifted by boom 14 to its required elevated position, not shown. Many bucket loaders have a self leveling circuit which tilts the bucket forward as the boom elevates so as to keep the bucket level. This function can also be accomplished manually by the operator working two valves at once. As shown in FIG. 4, loader bucket 10 can be lifted over an obstacle such as the wall of a bin for dumping. Bucket 10 is emptied by retracting cylinders 33A and 33B, causing front bucket assembly 52 to swing upward followed by ejector panel 60 which dumps the material from the bucket 10. As front bucket assembly 52 rotates in relation to back bucket assembly 32, ejector panel 60 is pulled by support legs 62 and 63 until it aligns with forward edges 44 of back bucket assembly 32 as shown in FIG. 7. As can be seen in FIG. 4, when ejector panel 60 rotates through back bucket assembly 32 it ejects loose material 70 out of back bucket assembly 32. Also as is shown in FIG. 4, while front bucket assembly 52 separate from and rotates away from back bucket assembly 32, any of loose material 70 held in front bucket assembly 52 falls from loader bucket 10. In this manner, loader bucket 10 can be lifted over a high obstacle and be emptied without having to rotate loader bucket 10 downward into a lower dumping position like conventional bucket loaders. Consequently, loader bucket 10 can be used in high clearance applications without having to obtain a larger and considerably more expensive tractor loader vehicle.

The skilled reader, in view of this specification, may envision numerous modifications and variations of the above disclosed preferred embodiment. Accordingly, the reader should understand that these modifications and variations, and the equivalents thereof, are within the spirit and scope of this invention as defined by the following claims, wherein

I claim:

1. A loader bucket assembly pivotally attached to a loader about a transverse horizontal axis for scooping, carrying and dumping loose materials comprising:

a back bucket assembly, a front bucket assembly defining an extension of the back bucket assembly and a mouth of the loader bucket, the front bucket assembly being pivotably mounted to said back bucket assembly;

an actuator means for pivoting the front bucket assembly relative to the back bucket assembly about a transverse axis;

said front bucket assembly further including an ejector panel secured to said front bucket assembly by support legs and adapted to swing behind said front bucket assembly and through said back bucket assembly as said front bucket assembly is pivoted by said actuator means;

said back bucket assembly having a lower wall that is cylindrically contoured to closely clear said ejector panel as it sweeps through said back bucket assembly.

2. The loader bucket assembly in accordance with claim 1, wherein said back bucket assembly further comprises bearings mounted concentrically in relation to said transverse axis on each side thereof, a transverse shaft adapted for pivotably mounting in said bearings, said transverse shaft secured to said front bucket assembly, said transverse shaft having at least one lug projecting therefrom, and said actuator means connecting said back bucket assembly to said at least one lug for pivotal actuation of the front bucket assembly relative to the back bucket assembly.

3. The loader bucket assembly in accordance with claim 1 wherein said lower wall of said back bucket assembly comprises a plurality of transverse bends defining a polygonal surface substantially approximating a cylindrical contour.

4. The loader bucket assembly in accordance with claim 1 wherein the ejector panel has side edges positioned approximate the sides of the loader bucket, said support legs for supporting said ejector panel connect the side edges of the ejector panel to the front bucket assembly.

5. A loader bucket for a tractor loader vehicle having an attachment fitting and a mouth, the bucket comprising:

a back bucket assembly and a front bucket assembly of welded construction, said back bucket assembly having a transverse axis, opposite side panels, a lower wall and a rear support structure, said side panels extending radially and downwardly from said transverse axis, said lower wall having a substantially cylindrical contour and disposed at a substantially constant radius from said transverse axis, said rear support structure supporting said back bucket assembly and having attachment means for releasably attaching to said loader vehicle, pivot means attached to each of said side panels at said transverse axis;

a front bucket assembly pivotally attached to the back bucket assembly along said transverse axis, said front bucket assembly having side walls, a bottom plate, an ejector panel means and support legs, said side walls and bottom plate defining an extension of the back bucket assembly and the mouth of the loader bucket, said ejector panel positioned behind said side walls and secured to said side walls by said support legs, said ejector panel means and said support legs adapted to pivot about said transverse axis without interfering with said lower wall and said side panels of said back bucket assembly, and an actuator means attaching the back bucket assembly to the front bucket assembly for rotating said front bucket assembly about said transverse axis.

6. The loader bucket in accordance with claim 5, wherein said back bucket assembly further comprises bearings mounted concentrically in relation to said transverse axis in each of said side panels, at least one support fitting mounted to said rear support structure of said back bucket assembly, a transverse shaft adapted for pivotably mounting in said bearings, said transverse shaft secured to each of said side walls of said front bucket assembly, said transverse shaft having at least one lug projecting therefrom, and said actuator means connected to at least one support fitting and to at least one lug.

7. The loader bucket in accordance with claim 5 wherein said lower wall comprises a plurality of transverse bends to define a polygonal surface substantially approximating a cylindrical contour.

8. A loader bucket for use with a tractor loader vehicle of the type having a loader bucket attachment means pivotally mounted to a boom, said loader bucket comprising:

a back bucket assembly adapted for mounting to said loader bucket attachment means;

said back bucket assembly having a pair of side panels, a transverse axis normally intersecting said side panels at the top margins thereof, rear support structure fastened to each said side panels, and a substantially cylindrically shaped lower wall fixed to said side panels positioned at a substantially constant radius from said transverse axis, said side panels and said lower wall defining a front edge opposite said rear support structure;

said front bucket assembly pivotally mounted to said back bucket assembly to pivot about said transverse axis in relation to said back bucket assembly, said front bucket assembly having side walls and a bottom plate defining an extension of the back bucket assembly and mouth of the loader bucket, said front bucket assembly also having an ejector panel carried by support legs secured to said front bucket assembly portion side walls, said support legs and said ejector panel adapted to swing about said transverse axis within said back bucket assembly without interference therewith for expelling contents in the loader bucket;

first actuator means for rotating said front bucket assembly relative to said back bucket assembly about said transverse axis;

second actuator means connecting the loader bucket to the boom for tilting the the loader bucket relative to the boom as it is raised or lowered;

said loader bucket is carried to an elevated position by said boom; and said first actuator means rotating said front bucket assembly in relation to said back bucket assembly about said transverse axis from a closed position to an open position, said front bucket assembly rotating up and away from said back bucket assembly, dumping said contents from said front bucket assembly, said ejector panel simultaneously swinging through said back bucket assembly from a closed position where said ejector panel is substantially adjacent to said rear support structure of said back bucket assembly to an open position where said ejector panel is aligned with said front edge of said back bucket assembly, said ejector panel sweeping said contacts of said back bucket assembly out from said back bucket assembly, whereby all the contents of said loader bucket are dumped without tilting the loader bucket downward by said second actuator means.

9. The loader bucket in accordance with claim 8, wherein said back bucket assembly further comprises bearings mounted concentrically in relation to said transverse axis in each of said side panels, a transverse shaft adapted for pivotably mounting in said bearings, said transverse shaft secured to each of said side walls of said front bucket assembly and to said ejector panel, said transverse shaft having at least one lug projecting therefrom, and said first actuator means is connected to said at least one lug.

10. The loader bucket in accordance with claim 8 wherein said lower wall comprises a plurality of transverse bends to define a polygonal surface substantially approximating a cylindrical contour.

* * * * *